US007560218B2

(12) United States Patent
Omatsu et al.

(10) Patent No.: US 7,560,218 B2
(45) Date of Patent: Jul. 14, 2009

(54) PROCESS FOR PREPARING TONER

(75) Inventors: Shinichiro Omatsu, Wakayama (JP); Shunji Arita, Wakayama (JP)

(73) Assignee: Kao Corporation, Tokyo (JP)

( * ) Notice: Subject to any disclaimer, the term of this patent is extended or adjusted under 35 U.S.C. 154(b) by 540 days.

(21) Appl. No.: 11/235,169

(22) Filed: Sep. 27, 2005

(65) Prior Publication Data

US 2006/0073404 A1 Apr. 6, 2006

(30) Foreign Application Priority Data

Oct. 1, 2004 (JP) ..... 2004-290840
Oct. 1, 2004 (JP) ..... 2004-290841

(51) Int. Cl.
*G03G 9/08* (2006.01)

(52) U.S. Cl. ..... 430/137.2; 430/108.7; 430/110.4; 430/137.21

(58) Field of Classification Search ..... 430/137.2, 430/137.18, 110.4, 108.7, 137.21
See application file for complete search history.

(56) References Cited

U.S. PATENT DOCUMENTS

| | | | | |
|---|---|---|---|---|
| 4,602,743 | A | 7/1986 | Nied | |
| 5,080,992 | A | 1/1992 | Mori et al. | |
| 5,193,751 | A | 3/1993 | Mori et al. | |
| 5,559,168 | A | 9/1996 | Mori et al. | |
| 5,716,751 | A * | 2/1998 | Bertrand et al. | 430/137.18 |
| 5,929,139 | A | 7/1999 | Mori et al. | |
| 6,171,744 | B1 | 1/2001 | Nakazawa et al. | |
| 6,543,710 | B2 | 4/2003 | Konetzka et al. | |
| 6,673,506 | B2 * | 1/2004 | Nakanishi et al. | 430/137.18 |
| 7,449,275 | B2 * | 11/2008 | Eida | 430/137.2 |
| 2001/0010888 | A1 * | 8/2001 | Izu et al. | 430/137.18 |
| 2003/0031481 | A1 * | 2/2003 | Miho | 399/222 |
| 2003/0178514 | A1 | 9/2003 | Makino et al. | |
| 2004/0253531 | A1 | 12/2004 | Ota et al. | |
| 2005/0095523 | A1 * | 5/2005 | Shimokusa et al. | 430/108.8 |
| 2006/0063094 | A1 * | 3/2006 | Eida | 430/137.2 |

FOREIGN PATENT DOCUMENTS

| | | |
|---|---|---|
| JP | 60-168547 | 9/1985 |
| JP | 2-167564 | 6/1990 |
| JP | 10-186721 | * 7/1998 |
| JP | 2000-275899 | 10/2000 |
| JP | 2001-293438 | 10/2001 |
| JP | 2002-35631 | 2/2002 |
| JP | 2002-131979 | 5/2002 |
| JP | 2003-280263 | 10/2003 |
| JP | 2004-70177 | 3/2004 |
| JP | 2004-73918 | 3/2004 |
| JP | 2004-198640 | 7/2004 |

OTHER PUBLICATIONS

USPTO English-language translation of JP 10-186721 (pub. Jul. 1998).*
U.S. Appl. No. 11/423,792, filed Jun. 13, 2006, Eida et al.
Patent Abstract of Japan, JP 11-216425, Aug. 10, 1999.
Patent Abstract of Japan, JP 2004-078063, Mar. 11, 2004.
Patent Abstract of Japan, JP 11-202551, Jul. 30, 1999.

* cited by examiner

*Primary Examiner*—Janis L Dote
(74) *Attorney, Agent, or Firm*—Oblon, Spivak, McClelland, Maier & Neustadt, P.C.

(57) ABSTRACT

A process for preparing a toner comprising the steps of (1) pulverizing a pulverized product of a composition comprising a resin binder and a colorant with a jet type pulverizer in the presence of fine inorganic oxide particles, to give an upper limit cut-off classification powder; and (2) classifying the upper limit cut-off classification powder with a classifier, the classifier comprising a classifying rotor comprising a driving shaft arranged in one casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor. The toner obtained according to the present invention can be used for, for example, developing a latent image formed in electrophotography, electrostatic recording method, electrostatic printing method, or the like.

15 Claims, 2 Drawing Sheets

PROCESS FOR PREPARING TONER

FIELD OF THE INVENTION

The present invention relates to a toner used for, for example, developing a latent image formed in electrophotography, electrostatic recording method, electrostatic printing method, or the like, and a process for preparing the toner.

BACKGROUND OF THE INVENTION

In recent years, there has been a demand for preparation of a toner having a small particle size and a sharp particle size distribution, from the viewpoint of formation of higher image qualities and the like. However, the smaller the particle size of the toner, the more likely the generation of aggregation between the particles, thereby making it difficult to classify the particles.

As for classifiers, besides generally conventionally used jet stream type classifiers, a classifier having a classifying rotor has been reported (see JP-A-Hei-11-216425 and JP2004-78063 A).

On the other hand, in the preparation of a toner containing a wax, a technique including the steps of mixing roughly pulverized products with fine inorganic oxide particles, and thereafter further pulverizing the mixture, has been reported (see JP-A-Hei-11-202551).

In addition, the more the intention of obtaining a toner having a smaller particle size, the more likely the generation of fine powders.

As a pulverizer, a fluidized bed type jet mill has been known as a pulverizer having high efficiency in pulverization (see JP-A-Showa-60-168547 and JP2002-35631 A). However, the smaller the particle size of the powder, the more likely the powders are aggregated, so that the fluidity is likely to be lowered. Therefore, the aggregated products may be deposited to or solidly fused on the inner wall of the pulverizer in some cases. In view of the above, a pulverizer provided with a layer made of a releasing agent on the side of the inner wall of the fluidized tank has been proposed (see JP2003-280263 A).

On the other hand, in the preparation of a toner containing a wax, a technique including the steps of mixing roughly pulverized products with fine inorganic oxide particles, and thereafter further pulverizing the mixture, has been reported (see JP-A-Hei-11-202551).

SUMMARY OF THE INVENTION

The present invention relates to

[1] a process for preparing a toner including the steps of:

(1) pulverizing a pulverized product of a composition containing a resin binder and a colorant with a jet type pulverizer in the presence of fine inorganic oxide particles, to give an upper limit cut-off classification powder; and (2) classifying the upper limit cut-off classification powder with a classifier, the classifier containing a classifying rotor containing a driving shaft arranged in one casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor; and

[2] a toner obtained by the process described in the above item [1].

Figure 1:
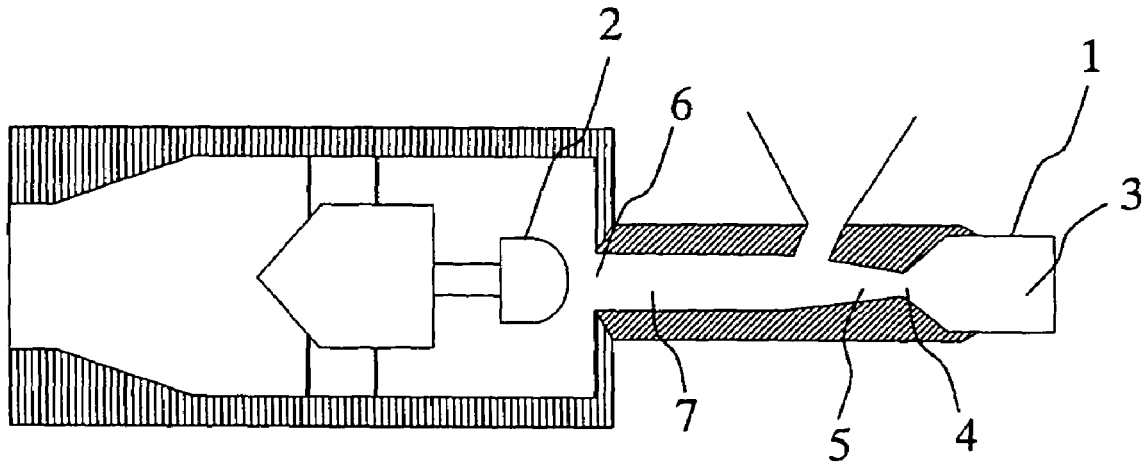
FIG. 1 is a schematic cross-sectional view showing one embodiment of the jet type pulverizer used in the present invention.

The explanation of the numerical symbols in the figure is as follows:

1 is a venturi nozzle, 2 an impact member, 3 an inlet, 4 a throat part, 5 a diffuser part, 6 an outlet, and 7 a straight part.

DETAILED DESCRIPTION OF THE INVENTION

The present invention relates to a process capable of efficiently preparing a toner having a small particle size and a sharp particle size distribution.

According to the present invention, a toner having a small particle size and a sharp particle size distribution can be efficiently prepared.

These and other advantages of the present invention will be apparent from the following description.

From the viewpoint of formation of higher image quality and the like, the preparation of a toner having a small particle size and a sharp particle size distribution has been desired. On the other hand, toners having smaller particles sizes are likely to cause aggregation between the particles, thereby making it difficult to classify the particles. Especially, in the case of a pulverized toner, the more finely the particles are pulverized, the larger the amount of the fine powders generated, so that the particle size distribution after the pulverization is likely to become broad.

The classifiers disclosed in JP-A-Hei-11-216425 and JP2004-78063 A are excellent in classification precision, as compared to the conventionally widely used jet stream type classifier. It is, however, desired to increase the classification precision for particles having small particle sizes of 7.5 μm or less, from the viewpoint of production efficiency of a toner.

In view of the above, the present inventors have studied on a method for increasing the classification precision for the upper limit cut-off classification powder, with a classifier having a classifying rotor. As a result, they have found that when the roughly pulverized product is finely pulverized in the pulverization step in the presence of fine inorganic oxide particles to give an upper limit cut-off classification powder is used, fine inorganic oxide particles which are properly embedded in the surface of the toner provide an excellent coating state in the surrounding of the pulverized particles, so that the classification precision for the upper limit cut-off classification powder is dramatically improved, and whereby furthermore a toner having a sharp particle size distribution can be efficiently obtained. Moreover, most of excess fine inorganic oxide particle which do not contribute to coating are removed during the upper limit cut-off classification in the pulverization step, so that a toner can be efficiently classified without adversely affecting the lower limit cut-off classification.

In the present invention, first, a pulverized product of a composition containing a resin binder and a colorant is prepared.

The resin binder usable in the present invention includes polyesters, styrene-acrylic resins, a mixed resin of a polyester and a styrene-acrylic resin, a hybrid resin containing two or more resin components, and the like. The resin binder containing a polyester as a main component is preferable, from the viewpoint of dispersibility of the charge control agent and the colorant, transparency thereof, and the like. The polyester is contained in the resin binder in an amount of preferably from 50 to 100% by weight, and more preferably from 70 to 100% by weight. As the hybrid resin, a resin in which a polycondensation resin, such as a polyester, a polyester-polyamide or a polyamide, and an addition polymerization resin such as a vinyl polymer-based resin are partially chemically bonded to each other is preferable. The hybrid resin may be obtained by using two or more resins as raw materials, or the hybrid resin may be obtained by using a mixture of one kind of resin and raw material monomers for the other resin. In order to efficiently obtain a hybrid resin, those obtained from a mixture of raw material monomers of two or more resins are preferable.

The raw material monomer for the polyester is not particularly limited, as long as a known alcohol component and a known carboxylic acid component such as carboxylic acids, acid anhydrides thereof and esters thereof are used.

The alcohol component includes an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.2)-2,2-bis(4-hydroxyphenyl)propane; ethylene glycol, propylene glycol, glycerol, pentaerythritol, trimethylolpropane, hydrogenated bisphenol A, sorbitol, or an alkylene (2 to 4 carbon atoms) oxide (average number of moles: 1 to 16) adduct thereof; and the like.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as trimellitic acid and pyromellitic acid; acid anhydrides thereof, alkyl (1 to 3 carbon atoms) esters thereof, and the like.

The polyester can be prepared by, for example, polycondensation of the alcohol component and the carboxylic acid component at a temperature of from 180° to 250° C. in an inert gas atmosphere in the presence of an esterification catalyst as desired.

The polyester has an acid value of preferably from 5 to 40 mg KOH/g, more preferably from 10 to 35 mg KOH/g, and even more preferably from 15 to 30 mg KOH/g.

In addition, the polyester has a softening point of preferably from 80° to 165° C. and a glass transition temperature of preferably from 50° to 85° C.

As the colorants usable in the present invention, all of the dyes, pigments, and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner prepared according to the present invention may be any of black toners and color toners. The amount of the colorant contained is preferably from 1 to 40 parts by weight, and more preferably from 3 to 10 parts by weight, based on 100 parts by weight of the resin binder.

It is preferable that the composition further contains a releasing agent. The releasing agent includes natural ester waxes such as carnauba wax and rice wax; synthetic waxes such as polypropylene wax, polyethylene wax and Fischer-Tropsch wax; petroleum waxes such as paraffin waxes; coal waxes such as montan wax; alcohol waxes; and the like. These waxes may be contained alone or in admixture of two or more kinds.

The releasing agent has a melting point of preferably from 50° to 120° C., and more preferably from 60° to 120° C., from the viewpoint of low-temperature fixing ability and offset resistance.

The amount of the releasing agent contained is preferably from 2 to 40 parts by weight, more preferably from 2 to 20 parts by weight, and even more preferably from 5 to 15 parts by weight, based on 100 parts by weight of the resin binder, from the viewpoint of printing durability and offset resistance. Usually, when the releasing agent is used in a large amount, the toner particles are easily aggregated each other, thereby making it likely to lower the pulverization efficiency. In the present invention, even when the releasing agent is used in a somewhat larger amount, pulverization can be efficiently carried out.

In the present invention, additives such as charge control agents, fluidity improvers, electric conductivity modifiers, extenders, reinforcing fillers such as fibrous substances, antioxidants, anti-aging agents, cleanability improvers, and magnetic materials may be further contained as raw materials in the toner.

In the present invention, it is preferable that a resin binder and a colorant, and an optional additive such as a releasing agent is previously mixed with a HENSCHEL MIXER and subjected to the step of melt-kneading. The melt-kneading of the raw material mixture can be carried out according to the conventional method with a closed type kneader, a closed type single-screw or twin-screw extruder, an open-roller type kneader or the like.

Next, the resulting melt-kneaded mixture is cooled to a pulverizable hardness, and thereafter, the cooled mixture is pulverized with Atomizer, Rotoplex, or the like.

Subsequently, the pulverized product of the composition is subjected to the step (1) in which the pulverized product is pulverized with a jet type pulverizer in the presence of fine inorganic oxide particles, to give an upper limit cut-off classification powder. The pulverized product of the composition subjected to the step (1) is hereinafter also referred to as "roughly pulverized product," and the pulverization of the pulverized product of the composition in the step (1) is hereinafter also referred to as "fine pulverization."

The roughly pulverized product to be subjected to the step (1) has a volume-median particle size ($D_{50}$) of preferably from 10 to 1000 μm, more preferably from 10 to 600 μm, and even more preferably from 10 to 300 μm, from the viewpoint of efficiently coating with the fine inorganic oxide particles.

In the present invention, the roughly pulverized product of a composition containing a resin binder and a colorant is finely pulverized with a jet type pulverizer in the presence of fine inorganic oxide particles, whereby the roughly pulverized product or a pulverized product thereof is collided with the fine inorganic oxide particles, to give an upper limit cut-off classification powder, the surface of which is coated with the fine inorganic oxide particles. Although not wanting to be limited by theory, it is considered that the upper limit cut-off classification powder, the surface of which is coated with the fine inorganic oxide particles, has a smaller aggregating force between the particles than those particles that are uncoated. Moreover, in the step (2) described below, when the upper limit cut-off classification powder, the surface of which is coated with the fine inorganic oxide particles, is classified with the classifier used in the present invention, the upper limit cut-off classification powder is sufficiently loosened without being aggregated to each other with a classifying rotor or a jet stream in the classifier, so that upper limit cut-off classification powders are classified in the state of single particles. Therefore, it is presumed that the classification precision is dramatically increased.

As the fine inorganic oxide particles, a conventionally known inorganic oxide such as silica, alumina, titania, zirconia, tin oxide, or zinc oxide can be used, without being particularly limited thereto. These can be used alone or in admixture of at least two kinds. In the present invention, among them, fine particles of silica are preferable, from the viewpoint of downsizing of toners and ensuring of fluidity.

Fine powders of silica ($SiO_2$) may be prepared by any of dry method or wet method. In addition, besides anhydrous silica, the fine powders of silica may be aluminum silicate, sodium silicate, potassium silicate, magnesium silicate or zinc silicate, and those having a $SiO_2$ content of 85% by weight or more is preferable.

In addition, the surface of the fine inorganic oxide particle may be subjected to hydrophobic treatment. The hydrophobic treatment method is not particularly limited. The hydrophobic treatment agent includes silane coupling agents such as hexamethyl disilazane (HMDS) and dimethyl dichlorosilane (DMDS); silicone oil treatment agents such as dimethyl silicone oil and amino-modified silicone oil; and the like. Among them, silane coupling agents are preferable. The amount treated by the hydrophobic treatment agent is preferably from 1 to 7 $mg/m^2$ per surface area of the fine inorganic oxide particle.

It is desired that the fine inorganic oxide particles have an average particle size of 0.001 μm or more, and preferably 0.005 μm or more, from the viewpoint of preventing embedment in the surface of the toner. It is desired that the fine inorganic oxide particles have an average particle size of 1 μm or less, and preferably 0.1 μm or less, from the viewpoint of ensuring fluidity and preventing a photoconductor from being damaged. Therefore, from the above viewpoints, the fine inorganic oxide particles have an average particle size of preferably from 0.001 to 0.1 μm, more preferably from 0.005 to 0.05 μm, and even more preferably from 0.01 to 0.04 μm. The average particle size as used herein is a number-average particle size calculated from 100 fine inorganic oxide particles when observed at a magnification of 50,000 with a transmission electron microscope (TEM).

It is desired that the amount of the fine inorganic oxide particles contained in the step (1) is 0.2 parts by weight or more, and preferably 0.5 parts by weight or more, based on 100 parts by weight of the roughly pulverized product, in order to obtain a toner having a sharp particle size distribution. It is desired that the amount of the fine inorganic oxide particles contained in the step (1) is 5 parts by weight or less, preferably 3 parts by weight or less, and more preferably 2 parts by weight or less, based on 100 parts by weight of the roughly pulverized product, in order to prevent generation of a free inorganic oxide in a large amount.

The process for finely pulverizing the roughly pulverized product in the presence of the fine inorganic oxide particles includes a process including the step of previously mixing a roughly pulverized product with fine inorganic oxide particles before pulverization; a process including the step of mixing a roughly pulverized product with fine inorganic oxide particles and at the same time feeding the mixture to a pulverizer; a process including the step of feeding a roughly pulverized product and fine inorganic oxide particles each from a separate feeding port to a pulverizer; and the like, without being particularly limited thereto. In the present invention, when two or more kinds of fine inorganic oxide particles are used, the process including the step of previously mixing the roughly pulverized product with the fine inorganic oxide particles is preferable, from the viewpoint of operability and uniformly depositing the fine inorganic oxide particle on the toner.

The roughly pulverized product and the fine inorganic oxide particle can be mixed, for example, with a mixer capable of agitating at a high speed, such as a HENSCHEL MIXER or a Super mixer.

The jet type pulverizer in the present invention refers to a pulverizer in which pulverization is carried out by colliding pulverized product with each other or colliding the pulverized product with an impact member by means of a jet gas stream. This jet type pulverizer includes a fluidized bed type jet mill, a jet stream type jet mill, and the like. In the present invention, the fluidized bed type jet mill is preferable.

While the preparation of a toner having a small particle size and a sharp particle size distribution has been desired from the viewpoint of formation of higher image quality and the like, the more finely the particles are pulverized, the larger the amount of the fine powders generated, so that the particle size distribution after pulverization is likely to become broad. For example, even though the pulverizers disclosed in JP-A-Showa-60-168547 and JP2002-35631 A have high efficiency in pulverization, the pulverizers cannot prevent the fine powders from being aggregated to each other. However, when the roughly pulverized product is finely pulverized with a fluidized bed type jet mill in the presence of fine inorganic oxide particles, fine inorganic oxide particles which are properly embedded in the surface of the toner provide an excellent coating state in the surrounding of the pulverized particles, thereby preventing the fine powders from being aggregated to each other, so that a toner having a small particle size can be efficiently obtained. In addition, since the lowering of the fluidity due to aggregation of the fine powders with each other can be prevented, it is unnecessary to form a layer made of a releasing agent on the side of the inner wall of the fluidized tank in the manner performed in JP2003-280263 A.

As the fluidized bed type jet mill usable in the present invention, preferable is a pulverizer having the structure and principle for finely pulverizing the particles, containing at least a pulverization chamber arranged facing two or more jet nozzles in its lower portion thereof, in which a fluidized bed is formed with the particles fed into the pulverizing container by a high-speed gas jet stream discharged from the jet nozzles wherein the particles are finely pulverized by repeating the acceleration of the particles and impact between the particles.

In the jet mill having the above-mentioned structure, the number of jet nozzles is not particularly limited. It is preferable that two or more jet nozzles, and preferably from 3 to 4 jet nozzles are arranged facing each other, from the viewpoint of balance between volume of air, amount of flow and flow rate, impact efficiency of the particles, and the like.

Further, a classifying rotor for capturing uplifted particles having small particle sizes downsized by pulverization is provided in an upper part of the pulverization chamber. Due to a centrifugal force generated by the classifying rotor, a large particle which does not achieve a desired particle size moves to the lower portion of the pulverization chamber, without being captured by the classifying rotor, and thereafter, the large particle is pulverized. The particle size distribution of particles substantially subjected to upper limit cut-off classification can be easily adjusted by a rotational speed of the classifying rotor.

The classifying rotor may be arranged in any of longitudinal direction and latitudinal direction against the vertical direction. It is preferable that the classifying rotor is arranged in the longitudinal direction, from the viewpoint of classifying performance.

Specific examples of a fluidized bed type jet mill containing two or more jet nozzles and further containing a classifying rotor include pulverizers disclosed in JP-A-Showa-60-166547 and JP2002-35631 A.

The fluidized-bed jet mill which may be preferably used in the present invention includes the "TFG" Series commercially available from Hosokawa Micron Corporation, the "AFG" Series commercially available from Hosokawa Micron Corporation, and the like.

It is preferable that the fluidized bed type jet mill satisfies the formula (A):

$$0.3<L/D<0.8 \quad (A)$$

wherein L is a nozzle distance of the jet nozzle, and D is a body diameter (inner diameter) of the jet mill, from the viewpoint of production efficiency. Here, the nozzle distance of the jet nozzle is defined as a diameter of a circle connecting the tip ends of the nozzles.

The adjustment of the nozzle distance is effective in increasing impact rate and impact force in pulverized efficiency, and the body diameter of the jet mill is effective in adjusting fluidized state of the product to be pulverized and the amount of particles carried along therewith. The adjustments of these factors can further increase the pulverization processing ability (feeding amount) by adjustment of a proper nozzle distance and/or selection of a proper body diameter of the jet mill.

In view of the above, the nozzle distance L and the body diameter D of the jet mill preferably satisfy the relationship of $0.4<L/D<0.7$, and more preferably satisfying the relationship of $0.55<L/D<0.65$.

In addition, as a jet stream type jet mill, for example, an impact type jet mill containing a venturi nozzle 1 and an impact member 2 arranged so as to face the venturi nozzle 1, as exemplified in the schematic cross-sectional view shown in FIG. 1, can be used.

Figure 2:
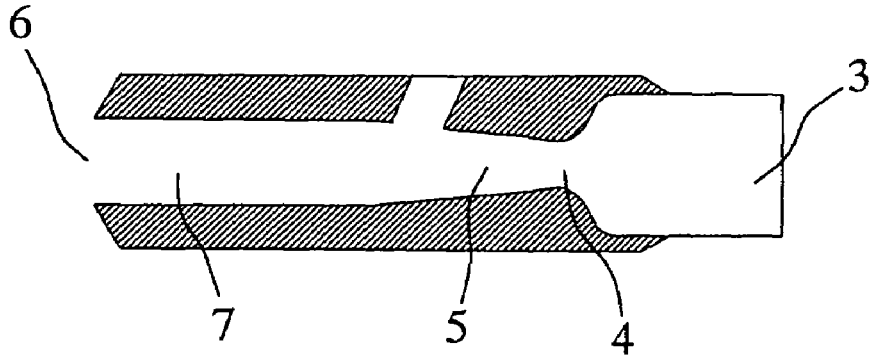
FIG. 2 is a schematic cross-sectional view showing one embodiment of the venturi nozzle preferably used in the present invention.

The venturi nozzle is a nozzle having a shape which is narrowed in the central part, in which the diameter of the nozzle tube is relatively dramatically decreased and then gradually expanded, the nozzle containing an inlet 3, a throat part 4, a diffuser part 5, and an outlet 6 in that order. A compressed gas introduced into the venturi nozzle 1 from the inlet 3 reaches its maximum rate at the throat part 4, and the high-speed gas stream thus produced thereby passing through the diffuser part 5 and colliding with the impact member. Therefore, the mixture fed into the nozzle from the feeding port for a product to be pulverized is transported along with the high-speed gas stream, and the transported mixture is finely pulverized by a large amount of an impact energy received on the impact member. It is preferable that the internal side of the throat part 4 in the venturi nozzle is in an arc shape smoothly and continuously connected from the inlet 3 to the diffuser part 5, as shown in FIG. 2. By using the venturi nozzle, the compressed gas is smoothly allowed to flow along the arc-shaped internal side, so that the loss of energy in the throat part 4 and the diffusion of energy in the diffuser part 5 are highly significantly and effectively suppressed, thereby enabling the mixture fed into the nozzle to collide with the impact member with a larger energy. The venturi nozzle can even more improve production efficiency together with the impact member of the present invention.

Furthermore, it is preferable that a straight part 7 on the outlet side of the diffuser part 5 is provided, so that the diffusion of energy is more suppressed, and that the product to be pulverized can be more finely pulverized with higher efficiency.

The venturi nozzle preferably used in the present invention includes, for example, a nozzle incorporated in a pulverizer described in JP2000-140675 A. Commercially available pulverizers having a venturi nozzle include, for example, "Impact Type Supersonic Jet Mill Model IDS-2" (commercially available from Nippon Pneumatic Mfg. Co., Ltd.), and the like.

The diameter of the outlet of the venturi nozzle depends upon the size of the impact type jet mill or the like. For example, in the above-mentioned "Impact Type Supersonic Jet Mill Model IDS-2", the outlet has a diameter of preferably from 10 to 15 mm or so.

The compressed gas introduced into the venturi nozzle includes air, nitrogen gas, and the like.

The pulverization pressure at the impact member by the high-speed gas stream formed with the compressed gas differs according to a volume-median particle size of a desired toner, or the like. Usually, the pulverizer can be used at a pulverization pressure of from 0.1 to 0.7 MPa or so.

The feeding amount of the product to be pulverized differs according to a volume-median particle size of a desired toner, or the like. For example, in the above-mentioned "Impact Type Supersonic Jet Mill IDS-2," the feeding amount of the product to be pulverized is preferably from 0.5 to 10 kg/h, more preferably from 1 to 5 kg/h, and even more preferably 3 kg/h or so.

The pulverization force on the product to be pulverized which is fed to the impact type jet mill can be adjusted by the feeding amount of the product to be pulverized, the pulverization pressure, or the like.

The impact member is not particularly limited and can be spherical, hemi-spherical, conical, or the like in its shape. From the viewpoint of improving pulverization efficiency, it is preferable that an impact member has a $r_2/r_1$ ratio of 0.3 or less, wherein $r_1$ is a radius of the largest circle $R_1$ among the circles formed with 3 points including any given 2 points, a and b, located on the outer circumference of the impact side of the impact member shown in FIG. 3, and one point c located on a line connecting the 2 points a and b in the shortest distance on the impact side; and $r_2$ is a radius of the largest circle $R_2$ among the circles formed with 3 points including any 2 points, a' and b', located on an outer circumference of the impact side, perpendicularly intersecting at a given point with the line connecting the 3 points forming the circle $R_1$, and one point c' located on a line connecting the 2 points a' and b' in the shortest distance on the impact side.

In the present invention, the impact side is a side on which a resin composition is to be collided or allowed to flow, and can be visually seen at least from the direction of the venturi nozzle. Moreover, it is preferable that the impact side is a side in which the line connecting 3 points for forming the circle $R_1$ is not bent, so that the 3 points are connected with a smooth line. The impact side does not have any particular limitation on its shape. Preferably, the impact side has a smooth round side or a smooth curved side.

Methods for obtaining the circles $R_1$ and $R_2$ will be specifically described hereinbelow.

First, any 2 points are set on the outer circumference of the impact side, to obtain a line connecting the 2 points in the shortest distance on the impact side (hereinafter referred to as line A). Next, any 1 point is set on the line A, to obtain a radius of a circle which passes through the point and the 2 points on the outer circumference of the impact side. This procedure is carried out at each point on the line A, to obtain a circle having the largest radius. Further, any other 2 points on the outer circumference of the impact side are used to obtain a circle giving the largest radius in the same manner as above, and the circle giving the largest radius is determined among all the circles obtained. This is the circle $R_1$. More understandably, the circle $R_1$ is determined for the purpose of selecting a straight line or a nearly straight line when viewed three-dimensionally, among the lines on the impact side.

Next, the circle $R_2$ is obtained. The purpose of obtaining the circle $R_2$ is to determine a straight line or a nearly straight line when viewed three-dimensionally, among the lines existing on the impact side orthogonal to the circle $R_1$. The circle $R_2$ can be obtained in the same manner as in the circle $R_1$ except for an additional condition that the line is orthogonal to the circle $R_1$. When each of the circles $R_1$ and $R_2$ exists in plurality, the circle closest to the center of gravity of the impact member when viewed three-dimensionally is selected.

As described above, the circles $R_1$ and $R_2$ are determined, so that their radii $r_1$ and $r_2$, and a ratio therebetween can be obtained. In the present invention, the ratio between $r_1$ and $r_2$, i.e., $r_2/r_1$, serves a measure of the degree of curvature on the impact side.

In the present invention, each of $r_1$ and $r_2$ is a numerical value that is not "0." When the 3 points forming a circle are present on a straight line, the radius of the circle is infinite. When the impact side is a planar surface, the $r_2/r_1$ ratio satisfies $\infty/\infty=1$. In addition, when a line connecting the 3 points forming the circle $R_2$ on the impact side is a curve, and a line connecting the 3 points forming the circle $R_1$ on the impact side is a straight line, the $r_2/r_1$ ratio satisfies finite numerical value/$\infty=0$.

Figure 3:
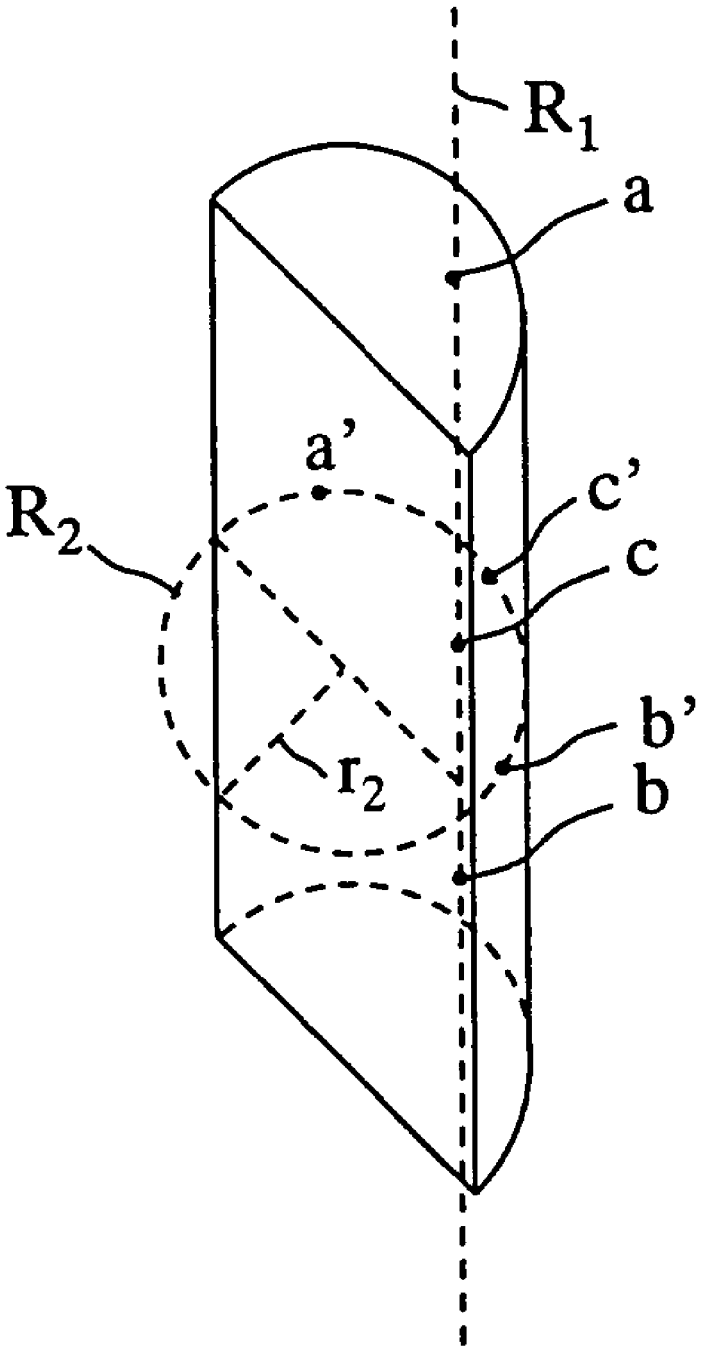
FIG. 3 is a schematic view showing a circle $R_1$; and a circle $R_2$ and a radius $r_2$ thereof; on the impact member of the present invention.

Specifically, the closer the $r_2/r_1$ ratio to 1, the more it is shown that the impact side is in an asymmetric form such as a spherical surface, a conical surface, a flat plate, or the like. On the other hand, the closer the $r_2/r_1$ ratio to 0, it is shown that the impact side is curved, and when the $r_2/r_1$ ratio is equal to 0, it is shown that the impact side is a side which is curved only in one direction of a flat plate. Circles $R_1$ and $R_2$, and a radius $r_2$ are shown in FIG. 3 in a case where the impact side is on a semi-cylindrical member containing a part of a true circle on its bottom side. In this case, the radius $r_1$ is infinite ($\infty$).

The $r_2/r_1$ ratio is preferably 0.1 or less, more preferably 0.05 or less, even more preferably 0.001 or less, and even more preferably 0.

The larger the radius $r_1$, the more favorable. When d is a radius of an opening in the outlet of the venturi nozzle, the radius $r_1$ is preferably 10 d or more, more preferably 100 d or more, and even more preferably infinite ($\infty$). Here, the phrase "$r_1$ is infinite" means that the line connecting 2 points forming a circle $R_1$ on the outer circumference of the impact side in the shortest distance as described above is a straight line, namely the line connecting the 3 points forming a circle $R_1$, is a straight line. It is preferable that the top part of the impact member, i.e., the most projected part of the impact side is located in the central part of the line connecting the 3 points forming the circle $R_2$ located on the outer circumference of the impact side. In addition, the most projected part of the impact side has a height of preferably from 0.2 $r_2$ to 3 $r_2$, and more preferably from 0.5 $r_2$ to 15 $r_2$.

The linear distance between the 2 points forming the circle $R_1$, located on the line on the outer circumference of the impact side is preferably from 2 d to 20 d, more preferably from 5 d to 15 d, and even more preferably from 7 d to 12 d.

The linear distance between the 2 points forming the circle $R_2$, located on the line on the outer circumference of the impact side is preferably from 0.3 d to 2 d, more preferably from 0.7 d to 1.3 d, and even more preferably from 0.9 d to 1.2 d.

The impact member preferably used in the present invention includes an impact member of which impact side has at least a part of a cylindrical member having a true circle or an oval on its bottom side. The cylindrical member may have a little bulge in the central part. It is preferable that the cylindrical member does not have any bulge. Also, the shape and size of sides at both ends of the impact side may be identical or different. It is preferable that the sides at both ends have the same shape, and more preferably the same size.

In addition, the impact member of which impact side has at least a part of the cylindrical member, is not limited to the cylindrical member itself, and includes one obtained by properly dividing the cylindrical member, for example, one obtained by dividing a cylindrical member perpendicular to the bottom side thereof. The side dividing the cylindrical member may be a side containing the central shaft of the cylindrical member, or a side without containment thereof. In the present invention, a hemi-cylindrical member is preferable, from the viewpoint of preventing generation of turbulence.

The sides at both ends of the impact side may be perpendicular to, slanted against, or smoothly curved to the impact side. It is preferable that the sides at both ends of the impact side are perpendicular to the impact side.

The materials for the impact member may be any of those that have wear resistance. The materials for the impact member include wear-resistant alloys, wear-resistant surface-treated metals, ceramics, and the like. Specifically, the materials include stellite alloy, Delchrome alloy, oxides such as alumina, titania, and zirconia, stainless steel, aluminum, iron, and the like, without being particularly limited thereto.

It is preferable that the impact member is arranged to face the outlet of the nozzle so that the line connecting 3 points for forming the circle $R_1$, and more preferably the most projected part on the line is located on the extension of the central shaft of the venturi nozzle. The closest distance between the outlet of the venturi nozzle and the impact member is preferably a distance such that a product to be pulverized is collided with the impact member and the pulverized product then smoothly flows in a rear direction, specifically from 3 d to 10 d. When the outlet of the venturi nozzle and the impact member are too close to each other, the flow of the product to be pulverized is disturbed, and when the outlet of the venturi nozzle and the impact member too far apart from each other, the impact energy is lowered.

In the step (1), the roughly pulverized product is pulverized, and thereafter the pulverized product is classified into coarse powders and upper limit cut-off classification powders, to give a pulverized upper limit cut-off classification powder. This upper limit cut-off classification powder has a volume-median particle size ($D_{50}$) of preferably from 3.0 to 7.5 μm, more preferably from 3 to 7 μm, even more preferably from 3 to 6.5 μm, and even more preferably from 3.5 to 5.5 μm, from the viewpoint of the particle size of the finally obtained toner. Here, the coarse powders removed in the step (1) may be subjected to the step (1) again for pulverization.

It is preferable that the number of particles on the coarse particle side is confirmed for the upper limit cut-off classification powder to be subjected to the step (2) together with the volume-median particle size ($D_{50}$).

The step (2) includes the step of classifying the upper limit cut-off classification powder with a classifier. One of the features of the step (2) resides in a classifier used.

The classifier used in the step (2) is a classifier containing a classifying rotor containing a driving shaft arranged in a casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor. Specific examples of the classifier having the structure described above include a classifier shown in FIG. 2 of JP-A-Hei-11-216425, a classifier shown in FIG. 6 of JP2004-78063 A, commercially available classifiers such as the "TSP" Series commercially available from Hosokawa Micron Corporation, and the like. The classification mechanism will be schematically explained hereinbelow.

The pulverized product fed into a casing of a classifier descends along a classification zone on the outer circumference of the classifying rotor while being led by the spiral guide vane. The inner part of the classifying rotor and the classification zone are communicated via a classifying vane provided on the surface of the outer circumference of the classifying rotor. When the pulverized product is descended, fine powders carried along with a classifying air are aspirated to the inner part of the classifying rotor via the classifying vane, and discharged from a discharging outlet for fine powders. On the other hand, coarse powders that are not carried along with the classifying air are descended along the classification zone by gravitational force, and discharged from a discharging outlet for coarse powders.

Further, it is preferable that the classifier used in the step (2) has two classifying rotors sharing the same driving shaft as a central shaft thereof in one casing, and that each of the classifying rotors independently rotates in the same direction. Specific examples of the classifiers provided with a classifying rotor on each of two top and bottom stages include a classifier shown in FIG. 1 of JP2001-293438 A, commercially available classifiers such as the "TTSP" Series commercially available from Hosokawa Micron Corporation, and the like.

When a classifying rotor is provided on each of two top and bottom stages, an even higher precision classification can be achieved by adjusting an aspiration rate of classifying air, a rotational speed in each classifying rotor, or the like.

For example, the ratio of the rotational speed of the upper classifying rotor to the rotational speed of the lower classifying rotor (the rotational speed of the upper classifying rotor/the rotational speed of the lower classifying rotor) is preferably from 1/1.05 to 1.05/1, and more preferably 1/1, from the viewpoint of preventing turbulence.

In addition, it is preferable that the amount of air flow introduced from an upper air aspiration inlet to the amount of air flow introduced from a lower air aspiration inlet is nearly equal, from the viewpoint of classification precision and yield of toner.

The toner of the present invention can be obtained through the steps of melt-kneading, pulverizing, and classifying as described above. It is preferable that the classifier used in the step (2) is used in the classification on the fine powder side (lower limit cut-off classification) to remove mainly fine powders. The fine powders removed during the classifying step may be subjected to the step (2) again so as to recapture the necessary portion of the fine powders by re-classification.

Usually, the smaller the particle size of a toner to be prepared, the more likely the aggregation of the particles of the toner with each other, so that the classification efficiency is likely to be lowered. However, in the present invention, even a toner having a particle size of preferably 8 μm or less, more preferably 7.5 μm or less, and even more preferably 6.5 μm or less can be prepared with high classification precision.

The toner obtained by the process for preparing a toner including the steps of (1) and (2) of the present invention has a volume-median particle size ($D_{50}$) of preferably from 3.5 to 8 μm, more preferably from 3.5 to 7.5 μm, even more preferably from 4 to 6.5 μm, and even more preferably from 4 to 6 μm. Here, the volume-median particle size refers to a median particle size in volume base particle size distribution.

Furthermore, the particles having particle sizes of 3 μm or less are contained in an amount of 3% by number or less, and preferably 2% by number or less, in the toner. The toner has a coefficient of variation of preferably 22% or less, more preferably 20% or less, and even more preferably 18% or less.

The toner obtainable by the present invention can be used without particular limitation in any of the development method alone as a toner for magnetic monocomponent development in the case where fine magnetic material powder is contained, or as a toner for nonmagnetic monocomponent development or as a toner for two-component development by mixing the toner with a carrier in the case where fine magnetic material powder is not contained. In addition, an external additive may be added to the toner obtainable by the present invention.

EXAMPLES

The following examples further describe and demonstrate embodiments of the present invention. The examples are given solely for the purposes of illustration and are not to be construed as limitations of the present invention.

[Softening Point]

The softening point refers to a temperature corresponding to h/2 of the height (h) of the S-shaped curve when plotting a downward movement of a plunger (flow length) against temperature, namely, a temperature at which a half of the resin flows out, when measured by using a flow tester (CAPILLARY RHEOMETER "CFT-500D," commercially available from Shimadzu Corporation), in which a 1 g sample is extruded through a nozzle having a die pore size of 1 mm and a length of 1 mm, while heating the sample so as to raise the temperature at a rate of 6° C./min and applying a load of 1.96 MPa thereto with the plunger.

[Glass Transition Temperature]

The glass transition temperature refers to a temperature of an intersection of the extension of the baseline of equal to or lower than the glass transition temperature and the tangential line showing the maximum inclination between the kick-off of the peak and the top of the peak, which is determined using a differential scanning calorimeter ("DSC 210," commercially available from Seiko Instruments, Inc.), by raising its temperature to 100° C., allowing to stand at 100° C. for 3 minutes, cooling the sample from this temperature to room temperature at a cooling rate of 10° C./min, and thereafter raising the temperature of the sample at a rate of 10° C./min.

[Acid Value]

The acid value is determined according to the method of JIS K0070.

[Particle Size Distribution]

The particle size distribution of the toner and the upper limit cut-off classification powder is determined with a COULTER COUNTER "Coulter Multisizer II" (commercially available from Beckman Coulter) according to the following method. Here, as to the upper limit cut-off classification powder, the amount on the side of coarse grains is confirmed. For example, in a case where the toner has a desired volume-median particle size of 4 to 6 μm, it is preferable that the contents of the particles having sizes of 6.35 μm or more and the particles having sizes of 8.00 μm or more. In addition, the value calculated by the standard deviation/$D_{50}$×100 of the volume base distribution is used as a coefficient of variation (CV value).

(1) Preparation of Dispersion: 10 mg of a sample to be measured is added to 5 ml of a dispersion medium (a 5% by weight aqueous solution of "EMULGEN 109 P" (commercially available from Kao Corporation, polyoxyethylene lauryl ether, HLB: 13.6)), and dispersed with an ultrasonic disperser for one minute. Thereafter, 25 ml of electrolytic solution ("Isotone II" (commercially available from Beckman Coulter)) is added thereto, and the mixture is further dispersed with the ultrasonic disperser for one minute, to give a dispersion.

(2) Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds.

(4) The volume-median particle size ($D_{50}$, μm) is obtained from the found values.

Preparation Example 1 OF Resin

A mixture of 350 g of polyoxypropylene(2.2)-2,2-bis(4-hydroxyphenyl)propane, 975 g of polyoxyethylene(2.2)-2,2-bis(4-hydroxyphenyl)propane, 299 g of terephthalic acid, 2 g of trimellitic acid, and 4 g of dibutyltin oxide was reacted at 230° C. under a nitrogen atmosphere until the softening point reached 113° C., to give a resin A in the form of a white solid. The resin A had a glass transition temperature of 66° C., a softening point of 113° C., an acid value of 6.0 mg KOH/g, and a hydroxyl value of 39.2 mg KOH/g.

Example 1-1

One-hundred parts by weight of the resin A, 3 parts by weight of a colorant "Pigment Yellow Y185" (commercially available from BASF), 6 parts by weight of a releasing agent "Carnauba Wax" (commercially available from Kato Yoko) and 3 parts by weight of a charge control agent "BONTRON E-84" (commercially available from Orient Chemical Co., Ltd.) were pre-mixed with a HENSCHEL MIXER, and thereafter the mixture was melt-kneaded with a twin-screw extruder.

The resulting melt-kneaded mixture was cooled, and roughly pulverized with a pulverizer "ATOMIZER" (commercially available from Tokyo Atomizer) so as to have a volume-median particle size ($D_{50}$) of 250 μm. One-hundred parts by weight of the resulting roughly pulverized product were mixed with 0.5 parts by weight of a hydrophobic silica "R-972" (commercially available from Nippon Aerosil, number-average particle size: 16 nm), and mixed with a 75-liter HENSCHEL MIXER at 1500 r/min for 1 minute while stirring.

[Step (1)]

One-thousand and five-hundred grams of the resulting mixture were fed at a feeding rate of 4.0 kg/h into an apparatus using a ceramic impact member having a semi-cylindrical shape, of which a bottom side is in the shape of a semicircle having a radius of 1 cm, and a height of 2 cm, in which a curved side serves as an impact side in an impact type jet mill (commercially available from Nippon Pneumatic Mfg. Co., Ltd., Model: IDS2), finely pulverized under a pulverization pressure of 0.6 MPa, and classified into coarse powder and fine powder. The fine powder was further classified with a cyclone to collect the upper limit cut-off classification powder. The ultrafine powder was aspirated with a bug dust collector connected to the cyclone. The resulting upper limit cut-off classification powder was repeatedly subjected to the procedures of pulverization with a pulverizer, collection to the cyclone and aspiration of ultrafine powder with the bug dust collector, to give a pulverized upper limit cut-off classification powder having a volume-median particle size of 4.0 μm.

[Step (2)]

The resulting upper limit cut-off classification powder was fed into a precision classifier "TTSP" (commercially available from Hosokawa Micron Corporation, Model 200) under the conditions of a feeding rate of 100 kg/h, rotational speed of upper and lower rotors of 4500 r/min, wind volume of upper and lower air aspiration inlets of 7.0 $m^3$/min, to give a yellow toner having a volume-median particle size of 4.8 μm and a coefficient of variance (CV value) of 18.6%. The yield against the weight of the upper limit cut-off classification powder to be subjected to the step (2) was 47.9%.

Example 1-2

The same procedures as in Example 1-1 were carried out except that 6 parts by weight of a colorant "Dimethyl Quinacridone" (commercially available from DAINICHISEIKA COLOR & CHEMICALS MFG. CO., LTD.) were used, to give an upper limit cut-off classification powder having a volume-median particle size of 3.9 μm by the step (1), and to give a magenta toner having a volume-median particle size of 4.5 μm and a coefficient of variance (CV value) of 16.7% by the step (2). The yield against the weight of the upper limit cut-off classification powder to be subjected to the step (2) was 52.7%.

Example 1-3

The same procedures as in Example 1-1 were carried out except that 3 parts by weight of a colorant "Copper Phthalocyanine" (commercially available from DAINICHISEIKA COLOR & CHEMICALS MFG. CO., LTD.) were used, to give an upper limit cut-off classification powder having a volume-median particle size of 4.1 μm by the step (1), and to give a cyan toner having a volume-median particle size of 4.6 μm and a coefficient of variance (CV value) of 18.3% by the step (2). The yield against the weight of the upper limit cut-off classification powder to be subjected to the step (2) was 62.9%.

Comparative Example 1-1

The same procedures as in Example 1-1 were carried out except that the hydrophobic silica was not mixed with the roughly pulverized product, to give a yellow toner. The yield against the weight of the upper limit cut-off classification powder to be subjected to the step (2) was 21.9%.

TABLE 1-1

| | Step (1) Presence or Absence of Inorganic Oxide | Step (2) Particle Size Distribution Before the Step $D_{50}$ (μm) | ≧6.35[1] (% by vol.) | ≧8.00[2] (% by vol.) | Step (2) Particle Size Distribution After the Step $D_{50}$ (μm) | CV Value (%) | Yield (%) |
|---|---|---|---|---|---|---|---|
| Ex. No. | | | | | | | |
| 1-1 | Present | 4.0 | 0.55 | 0.03 | 4.8 | 18.6 | 47.9 |
| 1-2 | Present | 3.9 | 0.57 | 0.00 | 4.5 | 16.7 | 52.7 |
| 1-3 | Present | 4.1 | 0.63 | 0.04 | 4.6 | 18.3 | 62.9 |
| Comp. Ex. No. | | | | | | | |
| 1-1 | Absent | 3.8 | 0.54 | 0.03 | 4.3 | 23.3 | 21.9 |

[1]Content of particles having particle sizes being 6.35 μm or more
[2]Content of particles having particle sizes being 8.00 μm or more It can be seen from the above results that the toners obtained in Examples 1-1 to 1-3 have higher yields, smaller amounts of fine powder generated, smaller particle sizes, and narrower particle size distribution as compared to those of the toner obtained in Comparative Example 1-1.

Reference Example 2-1

One-hundred parts by weight of the resin A, 3 parts by weight of a colorant "Pigment Yellow Y185" (commercially available from BASF), 6 parts by weight of a releasing agent "Carnauba Wax" (commercially available from Kato Yoko) and 3 parts by weight of a charge control agent "BONTRON E-84" (commercially available from Orient Chemical Co., Ltd.) were pre-mixed with a HENSCHEL MIXER, and thereafter the mixture was melt-kneaded with a twin-screw extruder. Thereafter, the resulting melt-kneaded mixture was roughly pulverized with the ATOMIZER at a rotational speed of 4,100 r/min so as to have a volume-median particle size ($D_{50}$) of 250 μm.

One-hundred parts by weight of the resulting roughly pulverized product were mixed with 1.2 parts by weight of a hydrophobic silica "R-972" (commercially available from Nippon Aerosil, number-average particle size: 16 nm), and mixed with a 150-L HENSCHEL MIXER at 840 r/min for 120 seconds.

The resulting mixture was finely pulverized and classified with a fluidized-bed jet mill "Model 400 TFG" (commercially available from Hosokawa Micron Corporation, number of nozzles: 3, nozzle diameter: 9 mm, nozzle distance L (diameter of a circle connecting tip ends of three nozzles): 280 mm, pulverization pressure: 0.8 MPa, body diameter D: 450 mm, L/D=0.62) at a rotational speed of 4220 r/min, so as to have a volume-median particle size ($D_{50}$) of 5.1 μm±0.1 μm. The particle size distribution and the feeding rate of the resulting pulverized upper limit cut-off classification powder are shown in Table 2-1. Here, the pulverizer itself is placed on a load cell (measuring equipment), and the pulverized upper limit cut-off classification powder having a given particle size is discharged from the center of the classifying rotor to an external of the system. The amount of the discharged powder is controlled by the load cell, wherein the system functions in a manner that the raw material mixture is supplied only in an amount corresponding to the amount reduced, and the supplied amount is defined as a feeding rate.

Reference Example 2-2

The same procedures as in Reference Example 2-1 were carried out except that the roughly pulverized product was not mixed with a hydrophobic silica, to give a pulverized upper limit cut-off classification powder.

Reference Example 2-3

The same procedures as in Reference Example 2-1 were carried out except that an impact type jet mill pulverizer "IDS-5" (commercially available from Nippon Pneumatic Mfg. Co., Ltd., impact member: attachment of Model IDS2, pulverization pressure: 0.50 MPa) was used in place of the fluidized-bed jet mill "Model 400 TFG," to give a pulverized upper limit cut-off classification powder.

Reference Example 2-4

The same procedures as in Reference Example 2-1 were carried out except that the nozzle distance L was changed to 250 mm, the body diameter D to 450 mm, and L/D to 0.56 in the fluidized-bed jet mill "Model 400 TFG," to give a pulverized upper limit cut-off classification powder.

Reference Example 2-5

The same procedures as in Reference Example 2-1 were carried out except that the nozzle distance L was changed to 315 mm, the body diameter D to 450 mm, and L/D to 0.70 in the fluidized-bed jet mill "Model 400 TFG," to give a pulverized upper limit cut-off classification powder.

Reference Example 2-6

The same procedures as in Reference Example 2-1 were carried out except that the nozzle distance L was changed to 215 mm, the body diameter D to 450 mm, and L/D to 0.48 in the fluidized-bed jet mill "Model 400 TFG," to give a pulverized upper limit cut-off classification powder.

TABLE 2-1

| Ref. Ex. No. | Presence or Absence of Inorganic Oxide Upon Pulverization | Particle Size Distribution of Pulverized Upper Limit Cut-Off Classification Powder $D_{50}$ (μm) | ≦4.00[1] (% by number) | ≧6.35[2] (% by volume) | ≧8.00[3] (% by volume) | Feeding Rate (kg/h) |
|---|---|---|---|---|---|---|
| 2-1 | Present | 5.07 | 22.9 | 10.2 | 0.9 | 26.8 |
| 2-2 | Absent | 5.18 | 21.4 | 14.6 | 1.9 | 18.1 |
| 2-3 | Present | 4.80 | 27.6 | 12.7 | 0.65 | (20)[4] |
| 2-4 | Present | 5.10 | 22.8 | 10.1 | 0.8 | 25.4 |
| 2-5 | Present | 5.13 | 22.6 | 10.4 | 0.9 | 21.6 |
| 2-6 | Present | 5.09 | 22.8 | 10.3 | 0.9 | 24.4 |

[1]Content of particles having particle sizes of 4.00 μm or less
[2]Content of particles having particle sizes of 6.35 μm or more
[3]Content of particles having particle sizes of 8.00 μm or more
[4]Actual feeding rate was 2.0 kg/h, but since the aeration rate of Model IDS2 (corresponding to energy supplied) is 1/10 that of Model 400 TFG, the value multiplied by a factor of 10 was given in the table as a calculated value.

It can be seen from the above results that the pulverized upper limit cut-off classification powders obtained in Reference Examples 2-1, 2-4 to 2-6 have higher feeding rates as compared to the pulverized upper limit cut-off classification powders obtained in Reference Example 2-2, so that the powders are efficiently pulverized. Further, the pulverized upper limit cut-off classification powders obtained in Reference Examples 2-1, and 2-4 to 2-6 have smaller contents of coarse powders having particle sizes of 6.35 μm or more and those having particle sizes having particle sizes of 8.00 μm or more, so that the classification precision is also improved.

Examples 2-1 to 2-5

The pulverized upper limit cut-off classification powders obtained in Reference Examples 2-1, and 2-3 to 2-6 were subjected to lower limit cut-off classification under the conditions given below. As a result, as shown in Table 2-2, toners having small particle sizes and sharp particle size distribution are obtained. In Example 2-2, in order to obtain a toner having a similar particle size distribution to those of Examples 2-1, 2-3 to 2-5, the yield was lowered than that of Example 2-1. This is considered to be due to the fact that the amounts of the coarse powders and the fine powders are increased even when the powder was pulverized in the presence of fine inorganic oxide particles, which in turn affected the subsequent lower limit cut-off classification. Even when the pulverized upper limit cut-off classification powder of Reference Example 2-2 were used, the improvement of the classification precision would be necessary, so that it is considered that the productivity is dramatically lowered even in the lower limit cut-off classification step.

[Classification Conditions]

Apparatus: Model 100 TTSP

Feeding rate: 11.8 kg/h

Rotational speed of rotors: 7700 r/min for both upper and lower rotors

Upper aeration rate: 1.6 $m^3$/min

Lower aeration rate: 1.9 $m^3$/min

TABLE 2-2

| Ex. No. | Pulverized Upper Limit Cut-off Classification Powder | Particle Size Distribution of Toner $D_{50}$ (μm) | ≦3.00[1] (% by number) | ≧8.00[2] (% by volume) | CV Value (% by volume) | Yield[3] (%) |
|---|---|---|---|---|---|---|
| 2-1 | Ref. Ex. 2-1 | 5.28 | 3.43 | 0.38 | 18.4 | 67.3 |
| 2-2 | Ref. Ex. 2-3 | 5.24 | 3.10 | 0.86 | 19.0 | 55.0 |
| 2-3 | Ref. Ex. 2-4 | 5.31 | 3.33 | 0.35 | 18.7 | 67.9 |
| 2-4 | Ref. Ex. 2-5 | 5.33 | 3.32 | 0.36 | 18.6 | 67.0 |
| 2-5 | Ref. Ex. 2-6 | 5.26 | 3.40 | 0.37 | 18.1 | 66.9 |

[1]Content of particles having particle sizes of 3.00 μm or less

[2]Content of particles having particle sizes of 8.00 μm or more

[3]Yield based on the pulverized upper limit cut-off classification powder

The toner obtained according to the present invention can be used for, for example, developing a latent image formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner comprising the following steps:

(1) pulverizing a pulverized product, which has a volume-median particle size ($D_{50}$) of from 10 to 1000 μm, of a composition comprising a resin binder and a colorant with a jet pulverizer in the presence of fine inorganic oxide particles, wherein the jet pulverizer is a fluidized bed jet mill, to give an upper limit cut-off classification powder; and (2) classifying the upper limit cut-off classification powder with a classifier, the classifier comprising two classifying rotors sharing a driving shaft arranged in one casing as a central shaft thereof in a vertical direction, and a stationary spiral guiding vane arranged to share the same central shaft as the classifying rotors, wherein the stationary spiral guiding vane is arranged in a classification zone on an outer circumference of the classifying rotors with a given spacing to the outer circumferences of the classifying rotors, wherein the toner has a volume-median particle size ($D_{50}$) of from 3.5 to 6.5 μm, wherein the fluidized bed jet mill satisfies a formula (A):

$$0.55<L/D<0.65 \quad (A)$$

wherein L is a nozzle distance of the fluidized bed jet mill, and D is a body diameter of the jet mill.

2. The process according to claim 1, wherein the fine inorganic oxide particle is a fine particle of silica.

3. The process according to claim 1, wherein the toner has a coefficient of variation of 22% or less.

4. The process according to claim 3, wherein the toner has a coefficient of variation of 18% or less.

5. The process according to claim 1, wherein the composition further comprises a releasing agent in an amount of from 2 to 40 parts by weight, based on 100 parts by weight of the resin binder.

6. The process according to the claim 1, wherein the pulverized product which has been subject to pulverizing in step (1) has a volume-median particle size ($D_{50}$) of from 10 to 600 μm.

7. The process according to the claim 1, wherein the pulverized product which has been subject to pulverizing in step (1) has a volume-median particle size ($D_{50}$) of from 10 to 300 μm.

8. The process according to the claim 1, wherein the fine inorganic oxide particles are present in step (1) in an amount of 0.2 parts by weight or more and 5 parts by weight or less, per 100 parts by weight of the pulverized product.

9. The process according to the claim 1, wherein the fine inorganic oxide particles are present in step (1) in an amount of between 0.5 parts by weight or more and 2 parts by weight or less, per 100 parts by weight of the pulverized product.

10. The process according to the claim 1, wherein the fine inorganic oxide particles have an average particle size of between 0.001 μm or more and 1 μm or less.

11. The process according to the claim 1, wherein the fine inorganic oxide particles have an average particle size of from 0.01 μm to 0.04 μm.

12. The process according to the claim 1, wherein the toner has a volume-median particle size ($D_{50}$) of from 4 to 6.5 μm.

13. The process according to the claim 1, wherein the toner has a volume-median particle size ($D_{50}$) of from 4 to 6 μm.

14. The process according to claim 1, wherein particles having particle sizes of 3 μm or less are contained in an amount of 3% by number or less in the toner.

15. The process according to claim 1, wherein particles having particle sizes of 3 μm or less are contained in an amount of 2% by number or less in the toner.

* * * * *